US009068388B2

(12) United States Patent
Costigan

(10) Patent No.: US 9,068,388 B2
(45) Date of Patent: Jun. 30, 2015

(54) STRAIN DISTRIBUTION CHECK LINK ASSEMBLY

(71) Applicant: GM Global Technology Operations LLC, Detroit, MI (US)

(72) Inventor: Terrence P. Costigan, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 74 days.

(21) Appl. No.: 13/873,612

(22) Filed: Apr. 30, 2013

(65) Prior Publication Data

US 2014/0318023 A1 Oct. 30, 2014

(51) Int. Cl.

| | |
|---|---|
| ***E05F 5/06*** | (2006.01) |
| ***E05D 3/02*** | (2006.01) |
| ***E05D 11/06*** | (2006.01) |
| *E05D 15/04* | (2006.01) |

(52) U.S. Cl.

CPC .. *E05F 5/06* (2013.01); *Y10T 16/61* (2015.01); *E05D 3/022* (2013.01); *E05D 11/06* (2013.01); *E05Y 2900/531* (2013.01); *E05D 15/04* (2013.01)

(58) Field of Classification Search

USPC ..... 49/501, 502, 503; 296/146.6, 187.12; 16/82, 83, 84, 85, 86 R, 86 A, 86 B, 86 C

See application file for complete search history.

(56) References Cited

U.S. PATENT DOCUMENTS

| | | | | |
|---|---|---|---|---|
| 2,232,986 | A * | 2/1941 | Westrope | 16/86 C |
| 2,290,331 | A * | 7/1942 | Jacobs | 16/86 C |
| 4,833,755 | A * | 5/1989 | Bonin | 16/344 |
| 5,727,287 | A * | 3/1998 | Hosken et al. | 16/82 |
| 5,862,570 | A * | 1/1999 | Lezuch et al. | 16/82 |
| 6,370,733 | B2 * | 4/2002 | Paton et al. | 16/86 C |
| 6,438,794 | B2 * | 8/2002 | Ng et al. | 16/82 |
| 6,446,305 | B1 * | 9/2002 | Kneeland | 16/82 |
| 6,564,424 | B1 * | 5/2003 | Audisio | 16/86 B |
| 6,813,811 | B2 * | 11/2004 | Matsuki et al. | 16/86 B |
| 6,871,382 | B2 * | 3/2005 | Murayama et al. | 16/82 |
| 6,901,630 | B2 * | 6/2005 | Liang et al. | 16/82 |
| 7,076,833 | B2 * | 7/2006 | Murayama et al. | 16/82 |
| 7,143,473 | B2 * | 12/2006 | Matsuki | 16/86 C |
| 7,240,399 | B2 * | 7/2007 | Murayama et al. | 16/82 |
| 7,383,614 | B2 * | 6/2008 | Matsuki | 16/86 B |
| 7,469,944 | B2 * | 12/2008 | Kitayama et al. | 292/262 |
| 7,530,141 | B2 * | 5/2009 | Heinrichs et al. | 16/86 C |
| 7,703,816 | B2 * | 4/2010 | Kitayama et al. | 292/262 |
| 7,739,836 | B2 * | 6/2010 | Keane et al. | 49/339 |
| 7,770,959 | B2 * | 8/2010 | Browne et al. | 296/146.12 |
| 7,793,387 | B2 * | 9/2010 | Clark | 16/86 C |
| 7,870,641 | B2 * | 1/2011 | Hoffmann et al. | 16/82 |
| 7,908,709 | B2 * | 3/2011 | Cruz et al. | 16/86 C |

(Continued)

*Primary Examiner* — Katherine Mitchell
*Assistant Examiner* — Justin Rephann
(74) *Attorney, Agent, or Firm* — Quinn Law Group, PLLC

(57) ABSTRACT

A check link assembly includes a link and a housing. The link includes a first link end portion, a second link end portion opposite the first link end portion, a first sidewall disposed between the first link end portion and the second link end portion, a second sidewall disposed between the first link end portion and the second link end portion, and a link extension protruding from the second link end portion. The link extension is closer to the first sidewall than to the second sidewall. The housing is movably coupled to the link and is configured to move relative to the link between a first housing position and a second housing position. The housing includes a mechanical stop disposed closer to the first sidewall than to the second sidewall.

20 Claims, 1 Drawing Sheet

(56) References Cited

U.S. PATENT DOCUMENTS

| | | | | |
|---|---|---|---|---|
| 7,971,393 | B2 * | 7/2011 | Gao et al. | 49/386 |
| 8,231,167 | B2 * | 7/2012 | Endo et al. | 296/187.12 |
| 8,424,159 | B2 * | 4/2013 | Domingo et al. | 16/85 |
| 2002/0148074 | A1 * | 10/2002 | Audisio | 16/344 |
| 2003/0037411 | A1 * | 2/2003 | Seo | 16/86 C |
| 2003/0051312 | A1 * | 3/2003 | Hoffmann et al. | 16/50 |
| 2006/0207058 | A1 * | 9/2006 | Heinrichs et al. | 16/86 B |
| 2007/0245519 | A1 * | 10/2007 | Woo | 16/86 C |
| 2011/0016665 | A1 * | 1/2011 | Ng | 16/85 |
| 2012/0192492 | A1 * | 8/2012 | Cutting | 49/394 |
| 2012/0233813 | A1 * | 9/2012 | Settsu et al. | 16/82 |
| 2013/0055530 | A1 * | 3/2013 | Gruber | 16/85 |
| 2013/0291336 | A1 * | 11/2013 | Hoffmann et al. | 16/85 |
| 2014/0041154 | A1 * | 2/2014 | Kamata et al. | 16/82 |
| 2014/0059802 | A1 * | 3/2014 | Matsuki | 16/82 |

* cited by examiner

STRAIN DISTRIBUTION CHECK LINK ASSEMBLY

TECHNICAL FIELD

The present disclosure relates to a check link assembly for uniformly distributing strain along a vehicle door.

BACKGROUND

Vehicles, such as cars, typically include one or more vehicle doors such as passenger doors or rear cargo doors. The vehicle doors can move relative to a vehicle body from a closed position to an open position to allow entry of persons or objects inside the vehicle. The movement of the vehicle door, however, can be limited by a check link assembly. When the vehicle door moves from the closed position toward the open position, the check link assembly can stop further movement of the vehicle door once the vehicle door has reached a predetermined position.

SUMMARY

The present disclosure relates to a checklink assembly for distributing stain on a sheet metal panel having multiple strain zones and being pivotally movable with respect to an attached body. In an embodiment, the checklink assembly includes an elongated link having one end pivotally attachable to the body and another end having a stop. The checklink assembly further includes a checklink housing movable along said elongated link. The checklink housing has a lateral portion inboard with respect to a pivotable attachment of said link to said body. The checklink housing is configured as a sidewall to engage and apply sufficient load to said stop when said housing moves to shift the load on said sheet metal panel sufficiently inboard with respect to said body and the strain zones of said sheet metal panel whereby to enable the downgaging of said sheet metal panel. The stop of the checklink assembly may be a hook engagable with the sidewall of the checklink housing when the housing moves.

The present disclosure relates to check link assemblies. In an embodiment, the check link assembly includes a link and a housing. The link includes a link body. The link body includes a first link end portion, a second link end portion opposite the first link end portion, a first sidewall disposed between the first link end portion and the second link end portion, a second sidewall disposed between the first link end portion and the second link end portion. The link body is elongated along a longitudinal axis. The link further includes a link extension protruding from the second link end portion in a direction substantially perpendicular to the longitudinal axis. The link extension is closer to the first sidewall than to the second sidewall. The housing is movably coupled to the link and is configured to move relative to the link between a first housing position and a second housing position. Further, the housing includes a mechanical stop disposed closer to the first sidewall than to the second sidewall. The mechanical stop is configured to contact the link extension when the housing is in the second housing position to limit further movement of the housing.

In an embodiment, the link extension is a hook. The link extension may define a recess configured to receive at least a portion of the mechanical stop. The mechanical stop may include an end stop portion configured to mate with the recess. Only the mechanical stop is configured to contact the link extension to limit the movement of the housing. The housing is slidably coupled to the link.

The present disclosure also relates to vehicles. In an embodiment, the vehicle includes a vehicle body, a vehicle door, and a check link assembly. The vehicle body defines a vehicle interior compartment. The vehicle door is movably coupled to the vehicle body and is configured to move relative to the vehicle body between an open position and a closed position. The check link assembly is coupled between the vehicle door and the vehicle body. Further, the check link assembly includes a housing coupled to the vehicle door. The housing includes a mechanical stop and is configured to move concomitantly with the vehicle door. The link is movably coupled to the vehicle body and the housing. The link includes a link body having a first link end portion and a second link end portion opposite the first link end portion. The link body is elongated along a longitudinal axis. The link further includes a link extension protruding from the second link end portion in a direction substantially perpendicular to the longitudinal axis. The mechanical stop is configured to contact the link extension when the vehicle door is in the open position in order to limit movement of the vehicle door.

In an embodiment of the vehicle, the link extension is a hook. Only the mechanical stop is configured to contact the link extension when the vehicle door is in the open position. The link includes a first sidewall and a second sidewall opposite the first sidewall, the first and second sidewalls being disposed between the first link end portion and the second link end portion. Further, the link extension is disposed closer to the first sidewall than to the second sidewall. The first sidewall is closer to the vehicle interior compartment than the second sidewall when the vehicle door is in the closed position. The mechanical stop is closer to the first sidewall than to the second sidewall. The link extension defines a recess configured to receive at least a portion of the mechanical stop. The mechanical stop includes an end stop portion configured to be received in the recess. The end stop portion has a substantially convex shape, and the recess has a substantially concave shape. The link includes a link body, and the link extension protrudes from the link body in a direction substantially perpendicular to the link body. The housing is slidably coupled to the link. The vehicle door includes an inner door panel and an outer door panel. The inner door panel is closer to the vehicle interior compartment than the outer door panel. The housing is coupled to the inner door panel. The mechanical stop is closer to the vehicle interior compartment than to the outer door panel when the vehicle door is in the closed position. The link extension is closer to the vehicle interior compartment than to the outer door panel.

In operation, the link extension of the check link assembly can apply a force (i.e., check load) to the mechanical stop at a location that is closer to the first sidewall than to the second sidewall of the link body, thereby uniformly distributing strain along the inner door panel of the vehicle door. As a result, the high strain zones in the inner door panel are eliminated or reduced.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Figure 1:
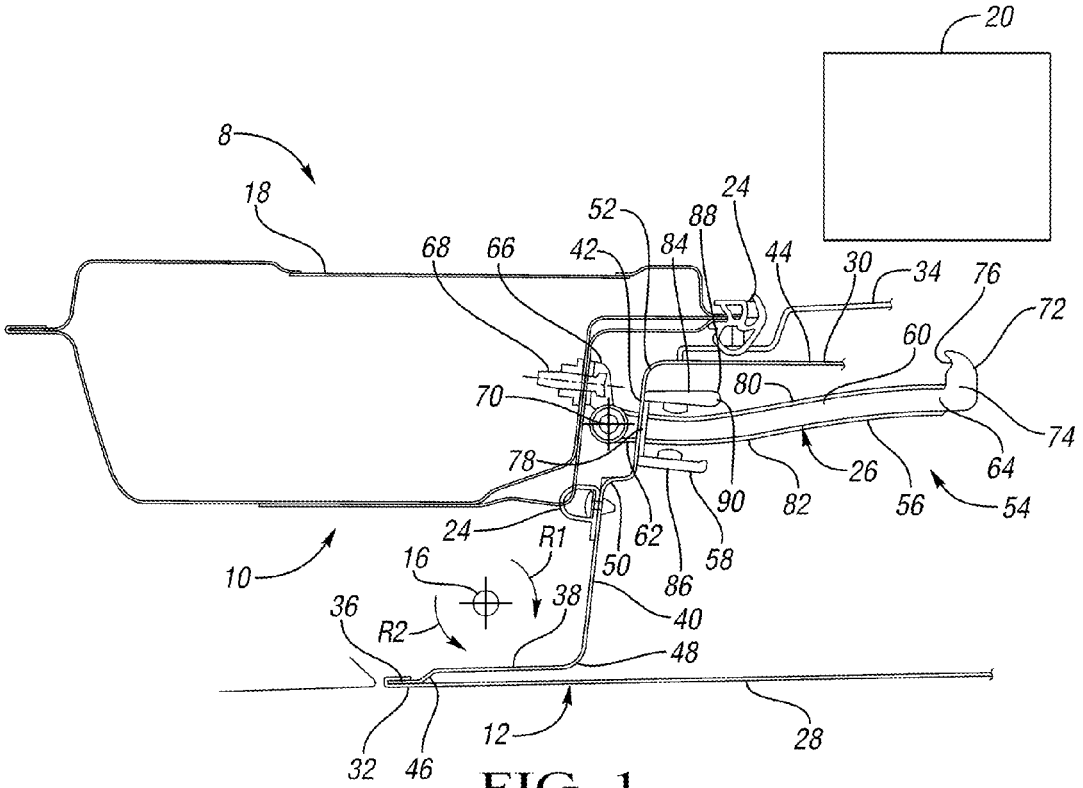
FIG. 1 is a schematic sectional top view, partly in elevation, of a portion of a vehicle including a vehicle body, a vehicle door, and a check link assembly coupled between the vehicle door and the vehicle body, showing the vehicle door in a closed position.
Figure 2:
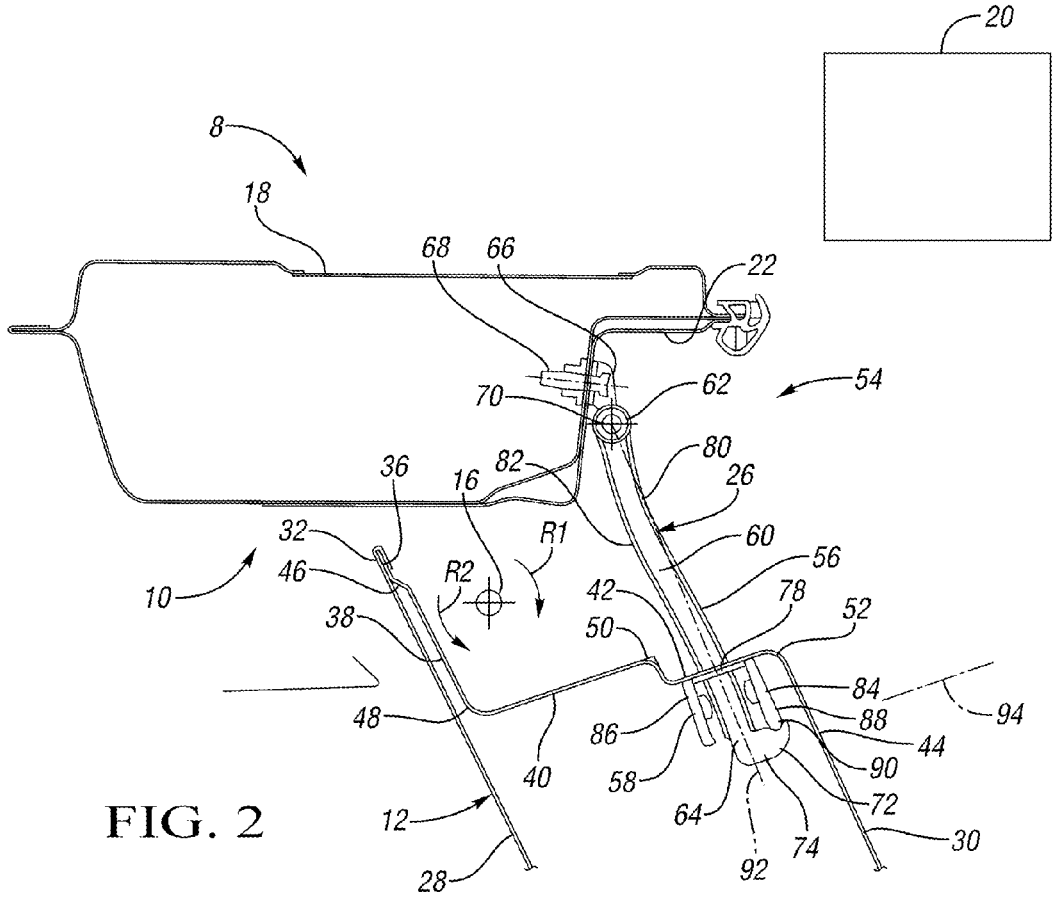
FIG. 2 is a schematic sectional top view of the portion of the vehicle of FIG. 1, showing the vehicle door in an open position.

Referring to the drawings, wherein like reference numbers refer to like components, FIGS. 1 and 2 show a portion of a vehicle 8 including a vehicle body 10. The vehicle body 10 includes one or more vehicle body pillars 18 to define one or more vehicle interior compartments. A vehicle interior compartment 20 may be a vehicle passenger compartment or vehicle cargo compartment. The vehicle body pillar 18 at least partially defines a vehicle door opening 22 leading to the vehicle interior compartment 20. It is envisioned that multiple vehicle body pillars 18 may entirely define a vehicle door opening 22.

The vehicle 8 further includes one or more vehicle doors 12 movably coupled to the vehicle body 10. One or more hinges (not shown) rotatable about hinge centerline 16 or any other suitable coupler can rotationally couple the vehicle door 12 and the vehicle body 10. In the depicted embodiment, the vehicle door 12 is pivotally coupled to the vehicle body 10. As such, the vehicle door 12 can rotate about the hinge centerline 16 in a first rotational direction as indicated by arrow R1 and a second rotational direction as indicated by arrow R2. The first rotational direction indicated by arrow R1 may be opposite to the second rotational direction indicated by arrow R2. Hence, the vehicle door 12 can move relative to the vehicle body 10 between an open position (FIG. 2) and a closed position (FIG. 1). Specifically, the vehicle door 12 can rotate about the hinge centerline 16 in the second rotational direction, which is indicated by arrow R2, to move from the open position (FIG. 2) toward the closed position (FIG. 1). In the closed position, the vehicle door 12 closes or covers at least a portion of the vehicle body opening 22. Conversely, the vehicle door 12 can rotate about the hinge centerline 16 in the first rotational direction, which is indicated by arrow R1, to move from the closed position (FIG. 1) toward the open position (FIG. 2). In the open position, the vehicle door 12 does not cover or close the vehicle body opening 22, thereby allowing entry of objects or humans into the vehicle interior compartment 20 via the vehicle body opening 22.

The vehicle 8 may further include one or more seals 24 disposed between the vehicle door 12 and a portion of the vehicle body 10 such as the vehicle body pillar 18. The seals 24 can minimize fluid flow between the vehicle interior compartment 20 and the outside atmosphere when the vehicle door 12 is in the closed position.

The vehicle door 12 may be wholly or partly made of a metallic material or sheet metal and includes an outer door panel 28 and an inner door panel 30 opposite the outer door panel 28. The inner door panel 30 may be attached to the outer door panel 28 at an end portion 32 of the vehicle door 12. The vehicle door 12 may further include a trim panel 34 (FIG. 1) coupled to the inner door panel 30.

The inner door panel 30 may include several panel portions. For instance, in the depicted embodiment, the inner door panel 30 includes at least a first inner panel portion 36, a second inner panel portion 38, a third inner panel portion 40, a fourth panel inner panel portion 42, and a fifth inner panel portion 44. The first inner panel portion 36 may be attached to the outer door panel 28 at the end portion 32 of the vehicle door 12. The inner door panel 30 further includes a first connecting portion 46, such as an elbow portion, interconnecting the first inner panel portion 36 and the second inner panel portion 38. The first inner panel portion 36 may be substantially parallel to the second inner panel portion 38. The inner door panel 30 is sheet metal and may include a second connecting portion 48, such as an elbow portion, interconnecting the second inner panel portion 38 and the third inner panel portion 40. The third inner panel portion 40 may be substantially perpendicular to the second inner panel portion 38. The inner door panel 30 may further include a third connecting portion 50, such as an elbow portion, interconnecting the third inner panel portion 40 and the fourth inner panel portion 42. The third inner panel portion 40 may be substantially parallel to the fourth inner panel portion 42. The inner door panel 30 additionally includes a fourth connecting portion 52, such as an elbow portion sometimes called a J-line, interconnecting the fourth inner panel portion 42 and the fifth inner panel portion 44. The fourth inner panel portion 42 may be substantially perpendicular to the fifth inner panel portion 44. The different sheet metal portions forming the inner door panel 30 incorporate multiple strain zones as they are configured.

The vehicle 8 further includes a check link assembly 26 coupled between the body pillar 18 and the vehicle door 12. The check link assembly 26 can limit movement of the vehicle door 12 in the first rotational direction indicated by arrow R1. In other words, when the vehicle door 12 moves from the closed position (FIG. 1) toward the open position (FIG. 2), the check link assembly 26 can stop further movement of the vehicle door 12 once the vehicle door 12 has reached a predetermined fully open position (FIG. 2). Thus, even when the user continues to apply a force or load to the vehicle door 12, the check link assembly 26 counteracts the force or load applied by the user and precludes, or at least inhibits, the vehicle door 12 from moving further in the first rotational direction indicated by arrow R1 once the vehicle door 12 has reached the predetermined fully open position (FIG. 2). When the check link assembly 26 counteracts the force applied by the user, the sheet metal inner door panel 30 tends to strain; however, the strain may not be distributed uniformly along the various strain zone portions of the inner door panel 30. Some portions of the door inner panel 30 may experience more strain than other portions of the inner door panel 30. For example, in the depicted vehicle door 12, the third connecting portion 50 may experience more strain than other portions of the inner door panel 30 when the check link assembly 26 limits further movement of the vehicle door 12 in the first rotational direction indicated by arrow R1. Consequently, the inner door panel 30 may have one or more high strain zones in its sheet metal structure such as the third connecting portion 50. As used herein, "high strain zones" refer to portions of the inner door panel 30 that experience more strain than other portions of the inner door panel 30 when the check link assembly 26 counteracts the force applied by the user to stop the vehicle door 12 at the predetermined fully open position (FIG. 2). To prevent, reduce or minimize strain in high strain zones, vehicle manufactures may adjust the thickness or gage of the inner door panel 30. It is desirable, however, to eliminate or reduce the high strain zones in order to reduce the thickness of the inner door panel 30. Reduced sheet metal gage lends to reduced mass and cost. In addition, an improved checklink configuration also improves link stop to housing alignment when the door is in full open position. It is therefore desirable to design a check link assembly that results in a substantially uniform strain distribution along the inner door panel 30 when the check link assembly stops the vehicle door 12 from moving further in the first rotational direction indicated by arrow R1.

The check link assembly 26 may be part of a vehicle door assembly 54. The vehicle door assembly 54 may also include the vehicle door 12, the hinge centerline 16, and at least a portion of the vehicle body 10 such as the vehicle body pillar 18. As discussed above, the check link assembly 26 is configured to stop, or at least inhibit, further movement of the vehicle door 12 once the vehicle door 12 has reached a predetermined fully open position (FIG. 2). In the depicted embodiment, the check link assembly 26 includes a link 56 and a housing 58 slidably disposed on the link 56. The link 56 includes an elongated link body 60. The elongated link body 60 includes a first link end portion 62 and a second link end portion 64 opposite the first link end portion 62. The first link end portion 62 is movably coupled to at least a portion of the vehicle body 10. For example, the first link end portion 62 can be pivotally coupled to the vehicle body pillar 18. In the depicted embodiment, the check link assembly 26 includes a bracket 66 coupled between the vehicle body pillar 18 and the first link end portion 62. A coupler 68 couples the bracket 66 to the vehicle body pillar 18. As such, the bracket 66 remains stationary relative to the vehicle body 10. A pivot pin 70 or any suitable coupler pivotally couples the first link end portion 62 to the bracket 66. Accordingly, the link 56 is pivotally coupled to the vehicle body 10 via the bracket 66 and the pivot pin 70. The link body 60 may further define a first sidewall 80 and a second sidewall 82 opposite the first sidewall 80. The first sidewall 80 is disposed closer to the vehicle interior compartment 20 than the second sidewall 82 when the vehicle door 12 is in the closed position (FIG. 1). Thus, the second sidewall 82 is disposed farther from the vehicle interior compartment 20 than the first sidewall 80 when the vehicle door 20 is in the closed position (FIG. 1). The first sidewall 80 and the second sidewall 82 are disposed between the first link end portion 62 and the second link end portion 64. The link 56 may be elongated along a link axis 92. Accordingly, the link body 60 defines the link axis 92 (FIG. 2) substantially along the length of the link 56. The link axis 92 may also be referred to as the longitudinal axis or as the first longitudinal axis.

The check link 56 is improved to include a link extension or stop 72 protruding from the link body 60. Specifically, the link extension 72 protrudes from the second link end portion 64 in a direction toward the vehicle interior compartment 20 of the vehicle body 10 when the vehicle door 12 is in the closed position (FIG. 1). For example, the link extension 72 may protrude from the second link end portion 64 only in a direction toward the vehicle interior compartment 20 when the vehicle door 12 is in the closed position. Thus, the link extension 72 is closer to the first sidewall 80 than to the second sidewall 82. The link extension 72 may be a hook and includes an extension body 74. Moreover, the link extension 72 may define an extension recess 76 (FIG. 1) extending into the extension body 74. The extension recess 76 may be substantially concave and is configured, shaped, and sized to receive a portion of the housing 58 as discussed in detail below. The link extension 72 may protrude from the link body 60 in a direction substantially perpendicular to the link axis 92 defined by the link body 60. In particular, the link extension 72 may be elongated along an extension axis 94 (FIG. 2). The extension axis 94 may be substantially perpendicular to the link axis 92 (FIG. 2). For example, the angle defined between the extension axis 94 and the link axis 92 may range between 80 degrees and 100 degrees. The extension axis 94 may also be referred to as the second longitudinal axis.

The check link assembly 26 further includes the housing 58 affixed to the vehicle door 12. Consequently, the housing 58 can move concomitantly with the vehicle door 12 between a first housing position (FIG. 1) and a second housing position (FIG. 2). The housing 58 is also movably coupled for movement with respect to the link 56. For example, the housing 58 may surround at least a portion of the link 56. As such, the housing 58 is slidably disposed on the link 56. Further, the housing 58 is configured to move along the link body 60 between the first link end portion 62 and the second link end portion 64 as the vehicle door 12 moves between the open position (FIG. 2) and the closed position (FIG. 1). As discussed above, the housing 58 can be configured to slide along the link body 60. While the vehicle door 12 moves from the closed position (FIG. 1) toward the open position (FIG. 2), the housing 58 urges the link 56 to move from a first link position (FIG. 1) toward a second link position (FIG. 2). Conversely, as the vehicle door 12 moves from the open position (FIG. 2) toward the closed position (FIG. 1), the housing 58 urges the link 56 to move from the second link position (FIG. 2) toward the first link position (FIG. 1).

The housing 58 further includes a housing support 78 directly attached to the inner door panel 30 of the vehicle door 12 using any suitable means such as welding, rivets, screws, among others. In the depicted embodiment, the housing support 78 is attached to the fourth inner panel portion 42 of the inner door panel 30 using, for example, nuts and studs. The housing support 78 may be substantially planar. The housing 58 may further include a first housing lateral portion 84 and a second housing lateral portion 86 both coupled to the housing support 78. The first housing lateral portion 84 is inboard with respect to said body 10 and is thus disposed closer to the first sidewall 80 of the link body 60 and the vehicle body 10 than the second housing lateral portion 86. The second housing lateral portion 86 is disposed closer to the second sidewall 82 of the link body 60 than the first housing lateral portion 84. Importantly, the first housing lateral portion 84 is configured to engage and apply sufficient load to the stop 72 of the link 56 when the housing 58 moves so as to shift the load on the panel 30 sufficiently inboard with respect to the pillar body 18 and the strain zone portions of the sheet metal inner door panel 30 to enable downgaging of the sheet metal panel 30.

More particularly, the housing 58 additionally includes a mechanical stop 88. The mechanical stop 88 may be coupled to, or monolithically formed with, the first housing lateral portion 84. The mechanical stop 88 includes an end stop portion 90 configured, shaped, and sized to be received in the extension recess 76. Specifically, the end stop portion 90 is configured, shaped, and sized to mate with the extension recess 76 to prevent, or at least inhibit, lateral movement of the housing 58 relative to the link 56 when the end stop portion 90 is received in the extension recess 76. For instance, the end stop portion 90 may have a substantially convex shape that substantially corresponds to a concave shape of the extension recess 76.

The mechanical stop 88 is configured to contact the link extension 72 when the vehicle door 12 is in the open position (FIG. 2) to limit further movement of the vehicle door 12 in the first rotational direction indicated by arrow R1. In the depicted embodiment, no other portion of the housing 58 (other than the mechanical stop 88) contacts the link 56 to limit further movement of the vehicle door 12 in the first rotational direction as indicated by arrow R1 when the vehicle door 12 is in the open position (FIG. 2). In other words, only the mechanical stop 88 is configured to contact the link 56 to limit the movement of the vehicle door 12. The mechanical stop 88 is disposed closer to the first sidewall 80 of the link body 80 than to the second sidewall 82. In other words, the mechanical stop 88 is disposed farther from the second sidewall 82 than from the first sidewall 80.

In operation, a user may apply a force or load to the vehicle door 12 to move the vehicle door 12 from the closed position (FIG. 1) toward the open position (FIG. 2). While moving from the closed position (FIG. 1) toward the open position, the vehicle door 12 pivots about the hinge centerline 16 in the first rotational direction as indicated by arrow R1. As the vehicle door 12 moves from the closed position (FIG. 1) toward the open position (FIG. 2), the housing 58 moves concomitantly with the vehicle door 12. While moving, the housing 58 urges the link 56 to move from the first link position (FIG. 1) toward the second link position (FIG. 2). While moving from the first link position (FIG. 1) toward the second link position (FIG. 2), the link 56 pivots about the pivot pin 70. When the vehicle door 12 reaches the open position (FIG. 2), the mechanical stop 88 contacts the link extension 72, thereby preventing, or at least inhibiting, further movement of the vehicle door 12 in the first rotational direction indicated by arrow R1 even if the user continues to apply force or load to the vehicle door 12. When the vehicle door 12 is in the open position (FIG. 2), the link extension 72 applies a force (i.e., check load) to the mechanical stop 88 at a location that is closer to the first sidewall 80 than to the second sidewall 82 of the link body 60. In other words, a checkload is applied through the inboard side of the housing 58, shifting the load closer to the J-line 52 of the inner door panel 30, thereby sufficiently uniformly distributing strain along the inner door panel 30 so that the thickness of the panel 30 may be minimized to enable gage reduction. As a result, the high strain zones in the inner door panel 30 are eliminated or reduced. In other words, the link extension 72 applies a force to the mechanical stop 88 at a location closer to the inner door panel 30 than to the outer door panel 28, thereby reducing high strain zones in the inner door panel 30. Positioning the mechanical stop 88 closer to the inner door panel 30 than to the outer door panel 28 results in a substantially uniform strain distribution along the inner door panel 30. For example, in the depicted embodiment, the strain in the third connecting portion 50 is minimized because the link extension 72 applies a force to the mechanical stop 88 at a location closer to the inner door panel 30 than to the outer door panel 28. Since the high strain zones in the inner door panel 30 are minimized due to the design of the check link assembly 26, the thickness or gage of the inner door panel 30 may also be reduced or minimized, thus resulting in weight reduction and desirable cost savings.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A check link assembly, comprising:

a link including a link body elongated along a longitudinal axis, the link body including a first link end portion, a second link end portion opposite the first link end portion, a first sidewall disposed between the first link end portion and the second link end portion, and a second sidewall disposed between the first link end portion and the second link end portion, wherein the link includes a link extension protruding from the second link end portion in a direction substantially perpendicular to the longitudinal axis, the link extension has a first extension end directly coupled to the link body and a second extension end opposite the first extension end, the second extension end is farther from the link body than the first extension end, the link extension defines a recess, and the recess is closer to the second extension end than to the first extension end; and a housing movably coupled to the link such that the housing is movable relative to the link between a first housing position and a second housing position, the housing including a mechanical stop disposed closer to the first sidewall than to the second sidewall;

wherein the mechanical stop is in direct contact with the link extension when the housing is in the second housing position;

wherein the recess is sized and shaped to at least partially receive the mechanical stop when the housing is in the second housing position.

2. The check link assembly of claim 1, wherein the link extension is a hook, and the mechanical stop is elongated along a stop axis that is parallel to the longitudinal axis at least when the housing is in the second housing position relative to the link.

3. The check link assembly of claim 1, wherein the link extension is elongated along an extension axis, the extension axis is perpendicular to the longitudinal axis, the link extension defines a first extension surface and a second extension surface opposite the first extension surface, the first extension surface faces toward the housing, the second extension surface faces away from the housing, the first extension surface includes a first surface portion directly connected to the link body, a second surface portion spaced apart from the first surface portion along the extension axis, and a third surface portion directly interconnecting the first surface portion and the second surface portion, the third surface portion is spaced apart from the first surface portion, the second surface portion, and the link body along the extension axis, and the recess is solely defined by the third surface portion.

4. The check link assembly of claim 3, wherein the mechanical stop includes an end stop portion, the end stop portion has a convex shape, the recess has a concave shape, the concave shape of the recess is complementary to the convex shape of the end stop portion, the recess is shaped and sized to mate with the end stop portion, and the recess only receives the end stop portion when the housing is in the second housing position.

5. The check link assembly of claim 3, wherein the housing is slidably coupled to the link, and the first extension end is spaced apart from the second extension end along the extension axis, the mechanical stop has a first lateral surface and a second lateral surface opposite the first lateral surface, the first lateral surface faces the link body, the second lateral surface faces away from the link body, and the second extension end is farther from the link body than the second lateral surface at least when the housing is in the second housing position.

6. The check link assembly of claim 1, wherein, aside from the mechanical stop, no other portion of the housing is in direct contact with the link extension when the housing is in the second housing position.

7. A vehicle comprising:

a vehicle body defining a vehicle interior compartment;

a vehicle door movably coupled to the vehicle body, the vehicle door being configured to move relative to the vehicle body between an open position and a closed position;

a check link assembly coupled between the vehicle door and the vehicle body, the check link assembly including:

a housing coupled to the vehicle door and including a mechanical stop, the housing configured to move concomitantly with the vehicle door;

a link movably coupled to the vehicle body and the housing, the link including a link body, the link body being elongated along a longitudinal axis and including a first link end portion and a second link end portion opposite the first link end portion, the link further including a link extension protruding from the second link end portion in a direction substantially perpendicular to the longitudinal axis, the housing being movable relative to the link between a first housing position and a second housing position, the link extension has a first extension end directly coupled to the link body and a second extension end opposite the first extension end, the second extension end is farther from the link body than the first extension end, the link extension defines a recess, and the recess is closer to the second extension end than to the first extension end;

wherein the mechanical stop is in direct contact with the link extension when the vehicle door is in the open position in order to limit movement of the vehicle door; and wherein the recess is sized and shaped to at least partially receive the mechanical stop when the housing is in the second housing position.

8. The vehicle of claim 7, wherein the link extension is a hook.

9. The vehicle of claim 7, wherein only the mechanical stop is configured to contact the link extension when the vehicle door is in the open position.

10. The vehicle of claim 7, wherein the link includes a first sidewall and a second sidewall opposite the first sidewall, the first and second sidewalls being disposed between the first link end portion and the second link end portion, and the link extension is disposed closer to the first sidewall than to the second sidewall.

11. The vehicle of claim 10, wherein the first sidewall is closer to the vehicle interior compartment than the second sidewall when the vehicle door is in the closed position.

12. The vehicle of claim 11, wherein the mechanical stop is closer to the first sidewall than to the second sidewall.

13. The vehicle of claim 7, wherein the recess has a concave shape.

14. The vehicle of claim 13, wherein the mechanical stop includes an end stop portion configured to be received in the recess.

15. The vehicle of claim 14, wherein the end stop portion has a substantially convex shape, and the recess has a substantially concave shape.

16. The vehicle of claim 7, wherein the link includes a link body, and the link extension protrudes from the link body in a direction substantially perpendicular to the link body.

17. The vehicle of claim 7, wherein the housing is slidably coupled to the link.

18. The vehicle of claim 7, wherein the vehicle door includes an inner door panel and an outer door panel, the inner door panel is closer to the vehicle interior compartment than the outer door panel, and the housing is coupled to the inner door panel.

19. A checklink assembly for distributing strain on sheet of metal panel having multiple strain zones and being pivotally movable with respect to an attached body comprising:

an elongated link having one end pivotally attachable to the body an another end having a link extension;

a checklink housing movable along said elongated link and having a mechanical stop inboard with respect to a pivotable attachment of said link to said body and configured as a sidewall to engage and apply sufficient load to said link extension when said housing moves to shift the load on said sheet metal panel sufficiently inboard with respect to said body and the strain zones of said sheet metal panel whereby to enable the downgaging of said sheet metal panel;

wherein the checklink housing is movable relative to the link between a first housing position and a second housing position;

wherein the link extension has a first extension end directly coupled to the link body and a second extension end opposite the first extension end, the second extension end is farther from the link body than the first extension end, the link extension defines a recess, the recess is closer to the second extension end than to the first extension end; and wherein the recess is sized and shaped to at least partially receive the mechanical stop when the checklink housing is in the second housing position.

20. The checklink assembly of claim 19, wherein said link extension is a hook engageable with said sidewall of said checklink housing when said checklink housing moves to the second housing position.

* * * * *